US006978651B2

(12) United States Patent
Fidziukiewicz

(10) Patent No.: US 6,978,651 B2
(45) Date of Patent: Dec. 27, 2005

(54) ROLLER CAM

(75) Inventor: Erich D. Fidziukiewicz, South Lyon, MI (US)

(73) Assignee: Anchor Lamina America, Inc., Farmington Hills, MI (US)

( * ) Notice: Subject to any disclaimer, the term of this patent is extended or adjusted under 35 U.S.C. 154(b) by 24 days.

(21) Appl. No.: 10/858,299

(22) Filed: Jun. 1, 2004

(65) Prior Publication Data

US 2005/0262920 A1 Dec. 1, 2005

(51) Int. Cl.[7] ..... B21D 5/04; B26D 5/16

(52) U.S. Cl. ..... 72/452.9; 72/315; 83/588; 74/110; 74/567

(58) Field of Search ..... 72/452.8, 452.9, 72/313, 319, 315; 83/588; 74/110, 567

(56) References Cited

U.S. PATENT DOCUMENTS 1,999,057 A * 4/1935 Peterson et al. ..... 72/452.8
5,101,705 A 4/1992 Matsuoka
5,231,907 A 8/1993 Matsuoka
5,269,167 A 12/1993 Gerhart et al.
5,347,838 A 9/1994 Matsuoka
5,487,296 A 1/1996 Gerhart et al.
5,746,082 A 5/1998 Matsuoka
5,784,916 A 7/1998 Matsuoka
5,884,521 A 3/1999 Fidziukiewicz
5,931,074 A 8/1999 Matsuoka
6,079,250 A * 6/2000 Scannell et al. ..... 72/381
6,196,040 B1 * 3/2001 Matsuoka ..... 72/315
6,519,995 B2 * 2/2003 Matsuoka ..... 72/312

* cited by examiner

*Primary Examiner*—David Jones
(74) *Attorney, Agent, or Firm*—Brooks Kushman P.C.

(57) ABSTRACT

A roller cam with pairs of sliding surfaces and wear plates located in an upper plane and with pairs of laterally slanted sliding surfaces and pairs of laterally slanted guiding wear plates located in a lower plane. The guiding wear plates are longitudinally contained between end plates to avoid using screws, which might loosen under stress, to secure the wear plates. Adjusting setscrews are used to laterally adjust the guiding wear plates, and positive return members are used to provide a tool retracting force in addition to that provided by a retracting spring.

9 Claims, 4 Drawing Sheets

ROLLER CAM

BACKGROUND OF THE INVENTION

1. Field of the Invention

The invention relates generally to aerial and die-mount cams and more particularly to improvements in die-mount roller cams having wear plates configured and disposed to facilitate assembly with increased precision and to provide an increased load-bearing capacity and a prolonged useful life.

2. Background Art

Since many large presses are capable of exerting force in only a vertical direction, mechanisms have been developed to make efficient use of components of the vertical force to provide useful forces in other directions. These are used to operate tools for such manufacturing operations as punching, trimming, stamping and bending.

Common among the mechanisms used are aerial and die-mount cams. Each of these typically includes three basic portions. An upper portion is connected to an upper shoe of a press, and a lower portion is connected to a lower shoe. A central portion, or slide, to which a tool can be secured, slidably resides between the upper and lower portions. If the upper portion is a cam adapter and the lower portion is a driver, the mechanism is commonly referred to as an aerial cam. If the upper portion is a driver and the lower portion is a cam adapter, the mechanism is referred to as a die-mount cam.

The slide, with its attached tool, is driven in a nonvertical direction when the upper portion is forced vertically toward the lower portion by the press. If the tool is, for example, a punch, it will be driven through a workpiece, for example, a metal panel, under urging of the press. The punch is typically withdrawn from the metal panel as the slide is retracted under a stripping force provided by a return spring. Return springs are subject to failure, however, and such failures can damage the roller cam and workpieces. At best, failed return springs need replacement, resulting in press downtime.

Wear plates are used between sliding surfaces that contact one another to reduce friction and increase element longevity. The wear plates must be capable of bearing the rated cam unit force supplied by the press and of dissipating thermal energy resulting from friction. Wear plates are typically secured in place with screws, and there is a danger that screws can become loose when brought under stress as a sliding surface is repeatedly forced against a wear plate and repeatedly forced to slide along it. Such an event could result in press downtime and damage to the roller cam and workpiece. Also, as their name implies, wear plates wear out with use and must be periodically replaced, which often requires disassembly and reassembly time.

Many aerial and die-mount cams have wear plates that are mounted so that their working surfaces are laterally horizontal. These wear plates provide support for the slide but provide little resistance to lateral yawing or vertical pitching of the slide. Any amount of pitching or yawing of the slide is likely to result in a proportional amount of inaccuracy in directing a tool to its desired target.

Commonly, present aerial and die-mount cams have profiles that are high enough to prevent their use in small presses. Many also have no provision for retracting their slides if the return springs used for this purpose jams or breaks.

SUMMARY OF THE INVENTION

An object of the present invention is to provide an improved roller cam including components to initially adjust and thereafter maintain proportional wear plate load distribution. The present roller cam has a slide having a parallel pair of spaced apart lower sliding surfaces disposed in a first plane and a parallel pair of spaced apart upper sliding surfaces disposed in a second plane parallel to and above the first plane. The roller cam also includes a cam adapter having a pair of guiding lower wear plates slidably supporting the pair of lower sliding surfaces and a pair of upper wear plates slidably supporting the upper sliding surfaces. The lower sliding surfaces are laterally canted downwardly toward each other and the guiding lower wear plates have laterally canted surfaces that parallel and guide the lower sliding surfaces. A cam roller is rotatably supported by the slide and responds to a downward motion of the driver by advancing the slide along the cam adapter. A pair of adjusting setscrews are supported by the cam adapter such that, when the setscrews are advanced, one of the pair of guiding lower wear plates is forced laterally toward the other and into contact with one of the pair of lower sliding surfaces to initially adjust, and thereafter maintain, proportional wear plate load distribution.

The roller cam further includes a driver having a linear cam surface angled relative to the vertical to force, in response to a downward motion of the driver, the slide along the cam adapter. A resilient member acting between the slide and the cam adapter biases the slide back toward its initial position. Additionally, positive return members are mounted on the driver to engage linear surfaces on keeper plates also mounted on the slide to ensure slide retraction.

The slide moves along a channel in the cam adapter. The upper wear plates are fastened to the cam adapter atop respective rims of the channel. The guiding lower wear plates are contained along respective sides at the bottom of the channel by end plates secured within slots in the cam adapter and the upper wear plates. Locating the pairs of wear plates in two planes allows an increase in their total surface area, thus increasing their load-bearing capacity and their longevity. The canted guiding lower wear plates also allows an increase in their total surface area and further contributes increased lateral stability to the slide. Mounting the wear plates in separate planes also facilitates the fabrication of narrower roller cams having the same load-bearing capacity.

The configuration of the roller cam provides convenient methods for its assembly and especially for assembling and adjusting the guiding lower wear plates. The use of slot-mounted end plates that contain the guiding lower wear plates requires no direct use of fastening devices such as screws, thus minimizing any possibility of a fastener loosening under stress.

DETAILED DESCRIPTION OF THE PREFERRED EMBODIMENT

Figure 1:
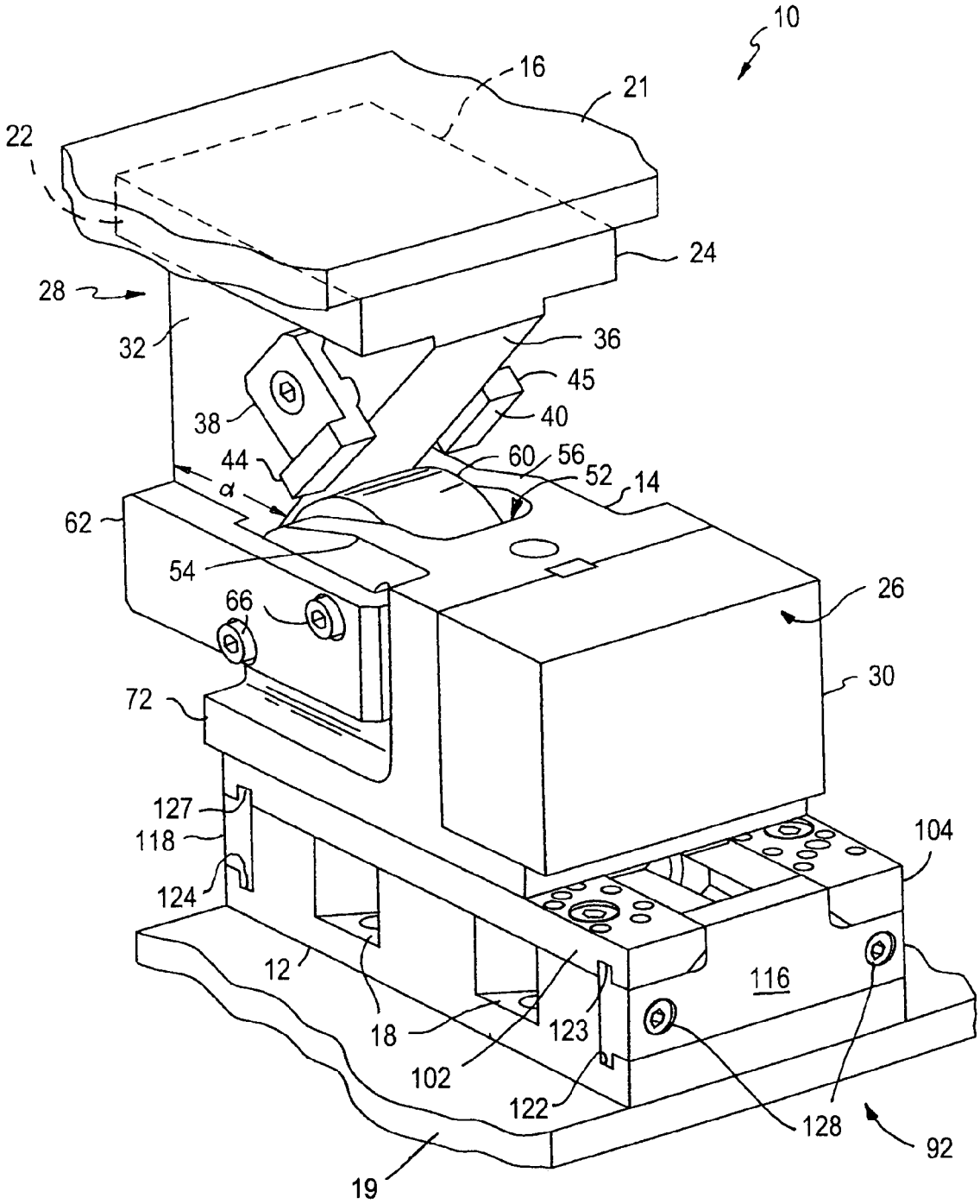
FIG. 1 is a perspective view of a roller cam and illustrates a combination of a driver, a cam roller, a slide and a cam adapter.

FIG. 1 shows a perspective view of a representative die-mount roller cam, generally indicated by the reference numeral 10, that includes a cam driving member, or cam adapter, 12, a tool holding member, or slide, 14, and a driver 16. The cam adapter 12 is secured, typically by bolts passing through bolt holes 20, to a lower die shoe 19 of a press (not shown). The driver 16 is similarly secured to an upper die shoe 21 of the press (not shown).

The slide 14, which has a front end, generally indicated by the reference numeral 26, and a rear end, generally indicated by the reference numeral 28, is sandwiched between the cam adapter 12 and the driver 16. The slide 14 is configured to move, in response to a component of a vertically downward force provided by the press, in a linear path along supporting surfaces of the cam adapter 12 at a desired angle to the vertical path of the upper die shoe 21 of the press. Mounted to the front end 26 of the slide 14 is a representative tool holder 30 capable of holding any of a number of well-known tools such as punches or trimmers (none of which is shown).

Figure 2:
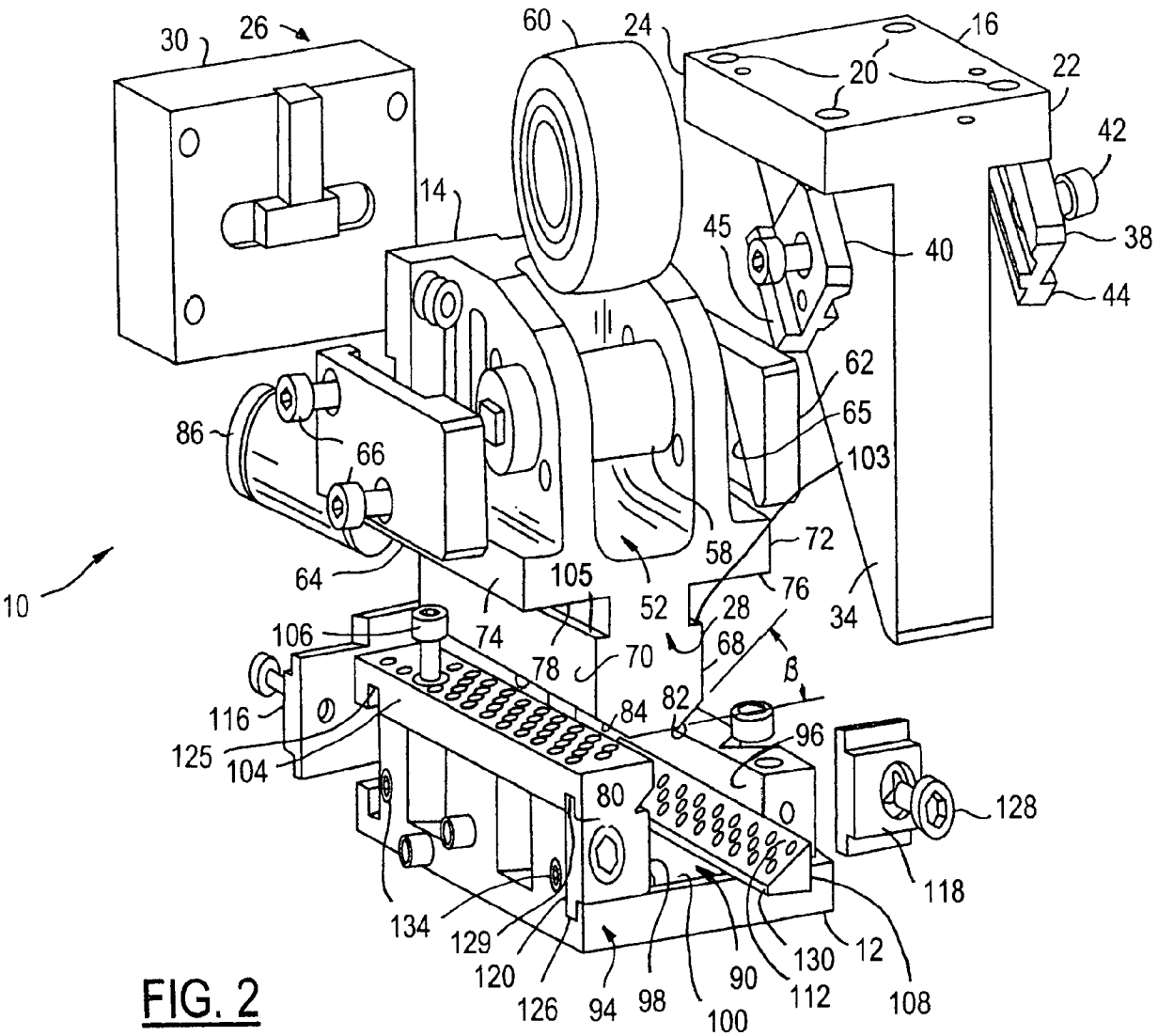
FIG. 2 is an exploded view, shown from an opposite perspective and including adjusting setscrews and a gas spring, of the roller cam of FIG. 1.

As illustrated in additional detail by FIG. 2, which is an exploded, reverse view of the die-mount roller cam 10 of FIG. 1, the driver 16 has first and second sides, 32 (FIG. 1) and 34 (FIG. 2) respectively, and a linear cam surface 36 (FIG. 1), which is disposed at an acute angle $\alpha$ (FIG. 1) relative to the vertical. First and second positive return members 38 and 40 are mounted on the respective sides of the slide 14 with fasteners such as screws 42. At ends distal from the screws 42 securing the positive return members 38 and 40 are respective return flanges 44 and 45 that extend laterally away from the respective sides of the driver 16.

Figure 4:
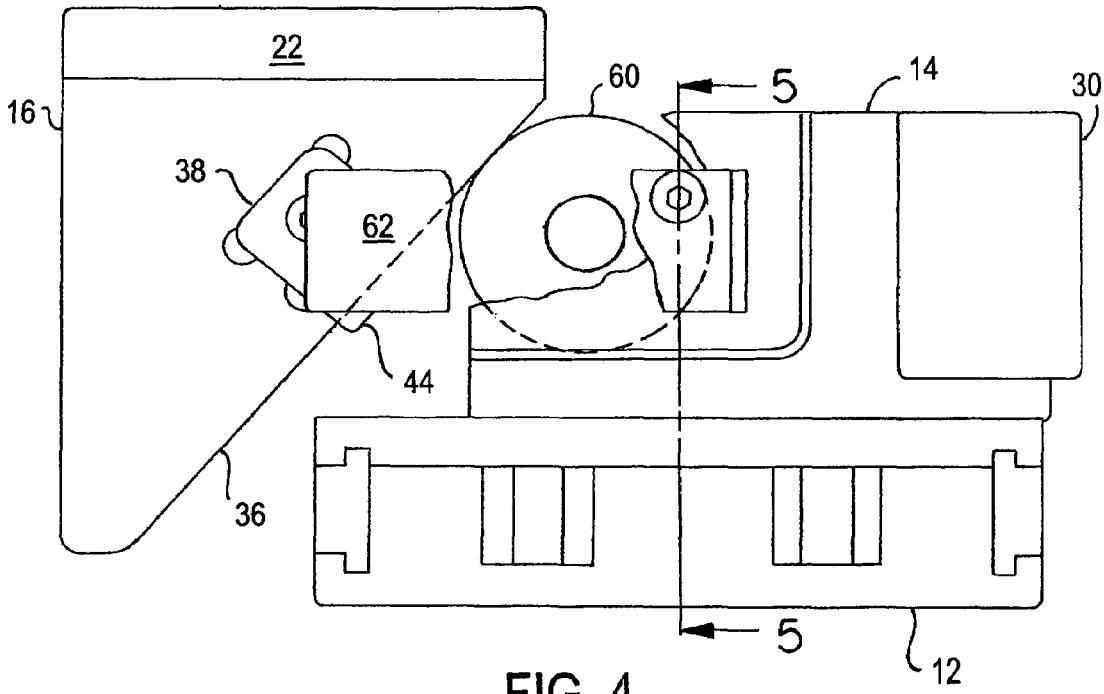
FIG. 4 is the side view, shown partially by hidden lines and partially broken away, of the roller cam of FIG. 3.
Figure 5:
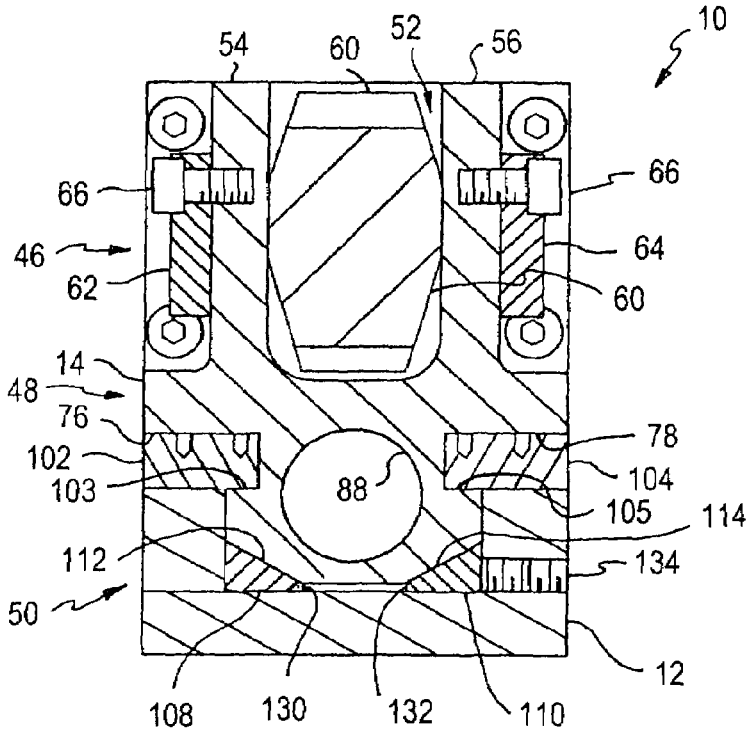
FIG. 5 is a cross-sectional view, taken on the line 5—5, of FIG. 4.

As best illustrated by FIG. 5, which is a cross-sectional view, taken on the line 5—5, of FIG. 4, the slide 14 includes an upper portion, generally indicated by the reference numeral 46, a central portion, generally indicated by the reference numeral 48, and a lower portion, generally indicated by the reference numeral 50. As shown by FIGS. 1 and 2, and additionally by FIG. 5, the upper portion 46 of the slide 14 houses an elongate, open cavity, generally indicated by the reference numeral 52. The cavity 52 is defined between parallel, vertical, first and second parallel side walls, 54 and 56 respectively. A laterally extending cam roller shaft 58 (FIG. 2) is supported between the first and second side walls 54 and 56, and a cam roller 60 is axially supported for rotation about the cam roller shaft 58.

Figure 3:
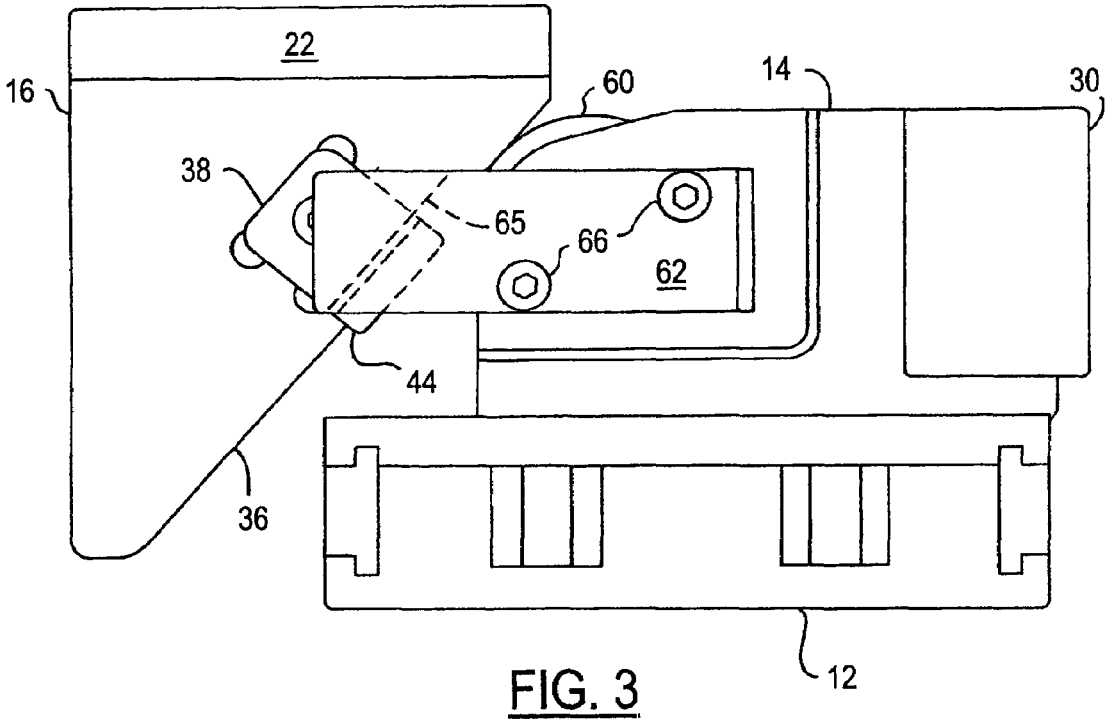
FIG. 3 is a side view, shown partially by hidden lines, of the roller cam of FIG. 1.

FIGS. 1 through 4 show elongate first and second keeper plates, 62 and 64 respectively, mounted on outer surfaces of the respective first and second side walls 54 and 56 of the slide 14 with fasteners such as screws 66. As illustrated best by FIGS. 3 and 4, the first keeper plate 62 extends beyond the cam roller 60 to engage the first positive return member 38. As shown by FIGS. 2 and 3, in the partially blocked view of the first keeper plate 62, the inner side of the first keeper plate 62 has a relieved portion that leaves a linear surface 65. The linear surface 65 is substantially parallel to the first return flange 44 of the first positive return member 38 to engage the first return flange 44 when the driver 16 moves upwardly. Although this feature is not shown, the second keeper plate 64 is configured in reverse of the first keeper plate 62 to engage the return flange 45 of the second positive return member 40.

As shown by FIGS. 2 and 5, the lower portion 50 of the slide 14 has first and second parallel sides, 68 and 70 respectively, that depend vertically from the central portion 48. The lateral thicknesses of the upper portion 46 and of the lower portion 50 of the slide 14 are less than the width of the central portion 48, over a rearward portion of the slide 14, leaving first and second flange-like projections, 72 and 74 respectively, extending laterally in opposite directions above the lower portion 50. Lower surfaces of the flange-like projections 72 and 74 form first and second upper sliding surfaces, 76 and 78 respectively. The lower portion 50 of the slide 14 also has a lower central slide surface 80 and further has first and second lower sliding surfaces, 82 and 84 respectively, that each angle laterally upwardly from an edge proximate the lower central slide surface 80 to an edge at a respective first and second parallel side 68 and 70 at an acute angle $\beta$ (FIG. 2) relative to the lower central slide surface 80.

As shown by FIG. 2, a resilient member, preferably a gas spring 86, is mounted within a longitudinal bore 88 (FIG. 5) in the front end 26 of the lower portion 50 of the slide 14. The gas spring 86 extends from the bore 88.

The cam adapter 12 has a general configuration of a right prism having a longitudinal, open channel, generally indicated by the reference numeral 90, extending through an upper portion from a front end, generally indicated by the reference numeral 92, to a rear end, generally indicated by the reference numeral 94, of the cam adapter 12. The channel 90 is defined between vertical, first and second parallel side walls, 96 and 98 respectively, and a lower central channel surface 100 extending between the side walls.

First and second upper wear plates, preferably self-lubricating wear plates, 102 and 104 respectively (the second upper wear plate not being shown in FIG. 2), each having a generally rectangular cross-section, are secured atop the first and second side walls, 96 and 98 respectively, with any of a number of well-known fastening devices such as bolts 106. First and second guiding lower wear plates, preferably self-lubricating wear plates, 108 and 110 respectively (FIG. 5), each having a generally wedge-shaped cross-section, are supported by the lower central channel surface 100 and longitudinally extend respectively along the side walls 96 and 98. The first and second guiding lower wear plates 108 and 110 have upper surfaces 112 and 114 that slope downwardly toward of each other.

The sliding surfaces are formed of harder material than the wear plates. The sliding surfaces are typically formed of hardened steel and the wear plates, of self-lubricating bronze. Preferably, the wear plates each contain a plurality of lubricating plugs.

The first and second guiding lower wear plates 108 and 110 are not retained in position by fasteners such as bolts, for example, that extend through the wear plates and into the cam adapter 12. Rather, they are contained laterally between the side walls 96 and 98, vertically between the lower central channel surface 100 and the slide 14, and longitudinally between a cam adapter front plate 116 and first and second cam adapter rear end plates, 118 and 120 respectively. The cam adapter front plate 116 is retained within a lateral slot 122 in the front end 92 of the cam adapter 12 and within lateral slots, 123 and 125 respectively, in the upper wear plates 102 and 104, the plate being secured to the cam adapter 12 by through-plate fasteners such as bolts 128 that extend through the front plate 116. The first and second cam adapter rear end plates 118 and 120 are retained within lateral slots 124 and 126 in the rear end 94 of the cam adapter 12 and in lateral slots, 127 and 129 respectively, in the upper wear plates 102 and 104, the plates being retained within the slots by through-plate fasteners such as bolts 128 that extend through the first and second rear end plates 118 and 120. With this configuration, the slots absorb forces that might loosen the fasteners.

The laterally sloping upper surfaces of the first and second guiding lower wear plates, 108 and 110 respectively, preferably do not extend sufficiently toward each other to terminate in sharp edges but rather form blunt surfaces 130 and 132 (FIGS. 2 and 5) extending generally vertically between the lower central channel surface 100 of the cam adapter 12 and the sloping wear plate surfaces 112 and 114. A pair of setscrews 134 extend laterally through the second side wall 98 to contact the second guiding lower wear plate 110. Advancing the setscrews 134 forces the second guiding lower wear plate 110 toward the first guiding lower wear plate 108.

The first and second upper wear plates 102 and 104 have larger lateral dimensions than the side walls 96 and 98 upon which they are mounted, and portions of each extend laterally above a portion of the channel 90. Accordingly, the slide 14 has first and second slots, 103 and 105 respectively, the upper surfaces of which form a an additional portion of the first and second upper sliding surfaces, 76 and 78 respectively. The wider wear plates 102 and 104 increase total wear plate surface area, and their disposition within the lateral slots 103 and 105 keeps the slide 14 against the cam adapter 12. This inhibits the front end of the slide 14 from pitching upwardly and from rolling when the driver 16 applies a downwardly directed component of force to the rear end of the slide 14, thus improving tool positioning accuracy.

When a die-mount roller cam 10 is initially assembled, and the first and second upper sliding surfaces, 76 and 78 respectively, and the first lower sliding surface 82 of the slide 14 are resting upon the first and second upper wear plates, 102 and 104 respectively, and the first guiding lower wear plate 108 of the cam adapter 12, the setscrews 134 are advanced so that the second guiding lower wear plate 110 just makes contact with the second lower sliding surfaces 84. The foregoing procedure represents a quick and efficient method for accurately adjusting the positions of wear plates at the point of roller cam assembly without resorting to wearing in the wear plates, or to using precision machining, to ensure a proportional load distribution. The procedure and the configuration of the roller cam have also been developed with an intent to provide a quick and efficient method for subsequent replacement and adjustment of the wear plates at a work site.

It will be understood by those skilled in the art that a second pair of setscrews (not shown) extending laterally through the first side wall 96 could be installed to urge the first guiding lower wear plate 108 toward the second guiding lower wear plate 110. Such a small amount of lateral displacement is required to position the wear plates, however, that the second pair of setscrews are not likely to be necessary.

In operation, when the driver 16 is forced vertically downwardly, the cam surface 36 of the driver 16 imparts a downward force against the cam roller 60 of the slide 14. The cam roller 60 communicates a component of the downward force to the slide 14 in a direction that forces the slide 14, and a tool (not shown) mounted in the tool holder 30 toward a workpiece (not shown). The first and second upper sliding surfaces, 76 and 78 respectively, of the slide 14 slide along the first and second upper wear plates, 102 and 104 respectively; and the first and second lower sliding surfaces, 82 and 84 respectively, slide along the first and second guiding lower wear plates, 108 and 110 respectively.

As the driver 16 is forced downwardly and the slide 14 is advanced, the gas spring 86 is compressed against the front plate 116 of the cam adapter 12. A tool, for example, a punch (not shown), is forced through a workpiece (not shown). When the driver 16 is raised, the gas spring exerts a force to retract the slide 14. If the slide 14 fails to retract, the first and second positive return members 38 and 40, being engaged with the linear surfaces 65 of the respective first and second keeper plates, 62 and 64 respectively, apply supplemental forces to ensure that the slide 14 is retracted.

Providing wider upper wear plates 102 and 104 and guiding lower wear plates 108 and 110 for the cam adapter 12 shown by FIG. 2 results in loads being distributed between two vertically displaced sets of wear plates. This allows an increase in their total surface area, with its attending increase in load-bearing capacity and longevity. Accordingly, the roller cam does not have to be as wide, therefore finding more applications in restricted operating locations, to manage the same load as a cam unit having the same total wear plate surface area but in the same plane. Conversely, a roller cam of the same width can manage higher loads due to a larger surface area over which to distribute the load. The canted guiding lower wear plates 108 and 110 also provide an increased total surface area relative to that of wear plates of the same width that are not canted. This not only increases their load-bearing capacity and longevity, it further provides increased lateral stability, thus improving tool positioning accuracy.

Figure 6:
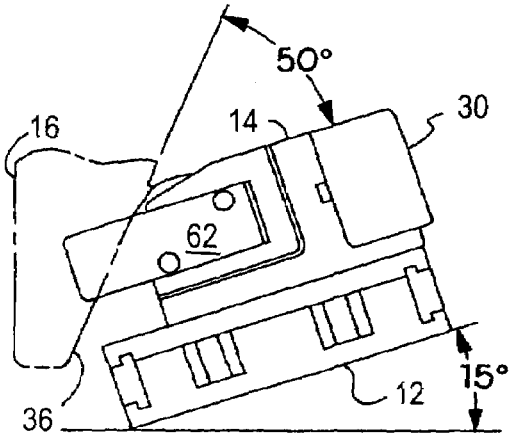
FIG. 6 is a side view of an upwardly inclined cam adapter and slide of the roller cam of FIG. 3.
Figure 7:
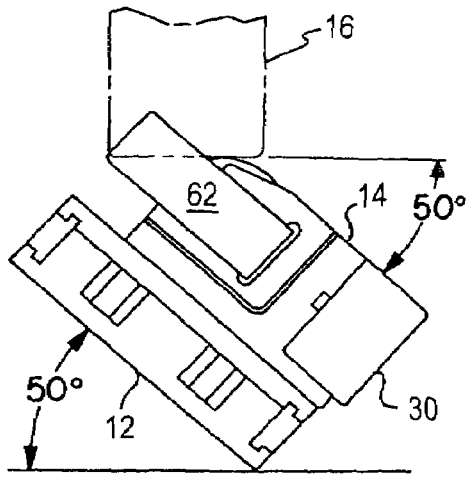
FIG. 7 is a side view of the downwardly inclined cam adapter and slide of the roller cam of FIG. 3.

FIGS. 6 and 7 illustrate die-mount roller cams 10 having cam adapters 12 that are representatively mounted at respectively upward and downward angles relative to the horizontal. Their operation would be similar to that of the roller cams 10 shown in previous figures; that is, a component of downward force applied by the press would force the slide 14, and a tool (not shown) mounted in the tool holder 30 in the direction of a workpiece (not shown). The upward and downward angles are representative of those used to orient tools to perform typical operations such as punching, trimming, stamping and bending. To accommodate mounting the cam adapter 12 at different angles to the horizontal, the keeper plates 62 and 64, positive return members 38 and 40, and drivers 16 can be replaced with others having appropriate configurations.

It will be understood by those skilled in the art that an inverted version of the roller cam, that is, with the cam adapter on the top and the driver on the bottom, could be constructed. Such a version would be an aerial cam.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A roller cam comprising:

a driver having a linear cam surface angled to the vertical;

a slide having a parallel pair of spaced apart lower sliding surfaces disposed in a first plane and a parallel pair of spaced apart upper sliding surfaces disposed in a second plane parallel to and above the first plane;

a cam adapter having a pair of guiding lower wear plates slidably supporting the pair of lower sliding surfaces, and a pair of upper wear plates slidably supporting the upper sliding surfaces, the lower sliding surfaces being laterally canted downwardly toward each other and the guiding lower wear plates having laterally canted surfaces that parallel and guide the lower sliding surfaces;

a cam roller rotatably supported by the slide and responsive to a downward motion of the driver by advancing the slide along the cam adapter; and a pair of adjusting setscrews supported by the cam adapter such that, when the setscrews are advanced, one of the pair of guiding lower wear plates is forced laterally toward the other and into contact with one of the pair of lower sliding surfaces to initially adjust, and thereafter maintain, proportional wear plate load distribution.

2. The roller cam as defined by claim 1, further comprising a resilient member that is compressed when the slide is advanced and that expands to retract the slide when the driver moves upwardly.

3. The roller cam as defined by claim 1, further comprising:

a positive return member mounted on each side of the driver;

a keeper plate mounted on each side of the slide, each keeper plate having a linear surface angled to the vertical, each positive return member engaging a respective one of the linear surfaces to ensure retraction of the slide when the driver moves upwardly.

4. The roller cam as defined by claim 3, wherein the cam adapter has a front end and a rear end and has a general configuration of a right prism having a longitudinal, open channel extending through an upper portion from the front end to the rear end, the channel being defined between vertical first and second parallel side walls and a lower central channel surface extending between the side walls, the cam adapter further comprising:

a front plate disposed across the front end of the cam adapter; and first and second rear end plates attached respectively to the first and second parallel side walls, each of the first and second rear end plates extending perpendicularly across a portion of the open channel, first and second guiding lower wear plates of the pair of guiding lower wear plates wholly being contained laterally between the first side wall and the adjusting setscrews in the second side wall, vertically between the lower central channel surface and the slide, and longitudinally between the front plate and the first and second rear end plates.

5. The roller cam as defined by claim 4, wherein the first and second upper wear plates are fastened atop the respective first and second side walls of the channel, each upper wear plate extending toward the other above a lateral portion of the channel, the slide having first and second lateral slots beneath respective first and second upper sliding surfaces to receive respective first and second upper wear plates, the slots minimizing vertical and lateral slide motion as the slide advances along the cam adapter.

6. The cam roller as defined by claim 5, wherein the cam adapter front plate and the first and second rear end plates are fit within lateral slots in respective ends of the cam adapter and of the upper wear plates as well as being secured to the cam adapter by through-plate fasteners, the slots absorbing forces that might loosen the fasteners and the configuration facilitating replacement and adjustment of the guiding lower wear plates.

7. The roller cam as defined by claim 6, wherein the sliding surfaces are formed of harder material than the wear plates.

8. The roller cam as defined by claim 6, wherein the sliding surfaces are formed of hardened steel and the wear plates are formed of self-lubricating bronze.

9. The roller cam as defined by claim 6, wherein the wear plates each comprise a plurality of lubricating plugs for lubricating upper surfaces.

* * * * *